United States Patent [19]

Haller et al.

[11] 4,351,487

[45] Sep. 28, 1982

[54] KNIFE ASSEMBLY FOR CHOPPING APPARATUS

[75] Inventors: Jack R. Haller, Wausau; William M. Haselton, New Berlin, both of Wis.

[73] Assignee: Murray Machinery, Inc., Wausau, Wis.

[21] Appl. No.: 187,164

[22] Filed: Sep. 15, 1980

[51] Int. Cl.[3] ..... B02C 18/18

[52] U.S. Cl. ..... 241/92; 241/292.1

[58] Field of Search ..... 241/92, 296, 298, 292

[56] References Cited

U.S. PATENT DOCUMENTS 3,981,337 9/1976 Sundström ..... 241/296 X 4,047,670 9/1977 Svensson ..... 241/92

*Primary Examiner*—Eugene F. Desmond

*Attorney, Agent, or Firm*—James E. Nilles

[57] ABSTRACT

A knife assembly for use in a chopping apparatus of the type having a rotatable disc and an opening therethrough to permit passage of the chopped material through and away from the disc. The assembly comprises a pair of knife holding means for engaging a reversible knife with two cutting edges. One of the knife holding means has a flat knife engaging surface for cooperatively engaging a complementary flat surface of the knife, and the other knife holding means has an arcuate protrusion for cooperatively engaging an arcuate groove in the knife. An improved elongated and reversible knife having opposed bevel surfaces that define the reversible cutting edges, and the knife also having opposite flat surfaces, one of which has an arcuate recess formed in and along that surface for the reception of a complementary shaped portion of a knife holding means.

3 Claims, 5 Drawing Figures

KNIFE ASSEMBLY FOR CHOPPING APPARATUS

BACKGROUND OF THE INVENTION

1. Field of Use

This invention relates generally to material chopping devices. In particular, it relates to a knife assembly for use in a chopping apparatus comprising a rotatable disc.

2. Description of the Prior Art

Knife assemblies for material chopping devices are of various types and include assemblies for engaging conventional one-edged knives and assemblies for the usually smaller, two-edged reversible knives. Such reversible knives have several advantages over their one-edged counterparts, particularly in their ease of handling, but suffer from some problems, whose remedies make the blades somewhat expensive.

Such knives and their assemblies are typically shown in U.S. Pat. No. 4,047,670, issued to Svensson, on Sept. 13, 1977, and entitled "Knife Device for a Chopper". The knife shown in FIGS. 2 and 3 therein is wedged between a first and a second knife holding means. The knife includes a pair of flat contact surfaces forming an angle, or being coangular, with each other and resting against corresponding contact surfaces of the first knife holding means, and also includes another pair of flat contact surfaces forming an angle with each other and resting against corresponding contact surfaces of the second knife holding means. Good contact and fit of the knives to the knife holding means is essential to ensure adequate heat transfer from the knives when the chopping apparatus is being operated and also to ensure that small pieces of the chopped material do not enter spaces created by a poor fit between the knives and the holding means. Good contact between the knives and the holding means in a knife having the flat and angled contact surfaces on each of its two sides as shown in Svensson requires that those knife contact surfaces be machined to very small and critical tolerances. If the angle between the knife's flat contact surfaces is off of its specification by only a small amount, at least one of the knife's flat contact surfaces will not abut a substantial part of the corresponding contact surface of the knife holding means. Thus, good heat transfer away from such knives and to the holding means can only be assured by maintaining strict manufacturing standards, an expensive requirement.

A non-coangular or straight knife contact surface would transfer the lowest stress concentrations to the knife holding means. Thus, by making the contact surfaces coangular, a higher stress is placed on the knife holding means and those means must then be constructed of a harder metal, and metal hardness is an important factor in such machine design.

The knives impact the material to be chopped, such as wood, at linear knife speeds of up to eighty miles per hour and are driven by considerable horsepower. As the knives impact the wood, tremendous forces are transmitted to those knives and transferred to the knife holding means. The smaller the area over which these forces are transmitted, the greater the force per unit area on the knife holding means and the harder and more expensive the metal of which they are constructed must be. The knives of some prior art devices have flat surfaces engaging both the first and second knife holding means, and flat surfaces offer very little area between adjacent workpieces. The importance of precisely maintained angles between the knife's flat contact surfaces forming an angle with each other is evident here as well, because imprecisely machined angles lower the area of the knife contacting the knife holding means and thus require the knife holding means to be constructed of metals stronger than would be necessary with properly machined angles.

The knife holding means, particularly the knife holding means adjacent the opening by which the chopped material passes through and away from the disc, is subjected to large amounts of thrust from the knife. That knife holding means thus acts as a thrust-bearing element and, as other thrust-bearing elements, wears after extended use and then requires replacement.

SUMMARY OF THE INVENTION

The present invention relates to a reversible knife and a knife assembly chopping apparatus of the type having a rotatable disc, knie holding means attached to the disc and adjacent a chip discharge opening in the disc, and a reversible knife clampingly engaged by the knife holding means. The knife holding means has a first knife engaging portion including an arcuate protrusion, and a second knife engaging portion including a flat knife engaging surface. The knife has two cutting edges and is clamped between the knife holding means. The knife has a complementary flat surface for cooperatively engaging the flat knife engaging surface of the knife holding means, and an arcuate groove for cooperatively engaging the arcuate protrusion of the knife engaging portion.

More specifically, one aspect of the invention relates to an arcuate protrusion on one of the knife holding means which permits the knife to be mounted by its arcuate groove and insured alignment between the knife holding means and knife and provides good contact thereagainst. The arcuate protrusion and groove combination insures good contact required between the parts for adequate heat transfer, cleanliness between the knife and knife holding means, and low transmittal of force per unit area from knife to knife holding means.

The knife of the present invention has two flat sides for engagement by two knife holding means. The first side has an arcuate groove, while the second side has a flat contact surface, which transfers less stress per unit area to its respective knife holding means and thus permits that holding means to be made of a metal less expensive than that required by a contact surface made with a coangular or other non-straight configuration.

Another aspect of the invention relates to the assembly above mentioned and which has a cylindrical or rod-like thrust element between the knife contact surface and the knife holding means. This thrust element wears out with time and is easily and inexpensively replaced, particularly when compared to the cost of replacement of the knife holding means which would act as the thrust element in the absence of the cylindrical or rod-like element.

The present invention furthermore provides an improved elongated and reversible knife for attachment to a chopping disc. The improved knife has two opposite cutting edges each defined by two intersecting bevelled surfaces, and a pair of opposite flat surfaces are located between the bevelled surfaces. An arcuate recess is formed in and along one of the flat surfaces of the knife and acts to receive a complementary shaped projectin of a knife holding means secured to the chopping disc.

These and other objects and advantages of the present invention will appear hereinafter asthis disclosure progresses, reference being had to the accompanying drawings.

DESCRIPTION OF A PREFERRED EMBODIMENT

Figure 1:
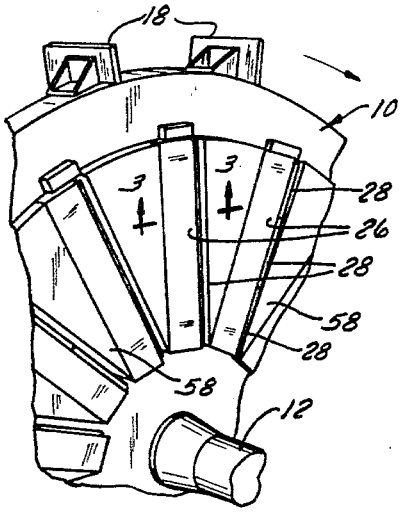
FIG. 1 is a perspective view of a part of a rotatable chopping disc within which the knife assembly comprising the invention is mounted.
Figure 2:
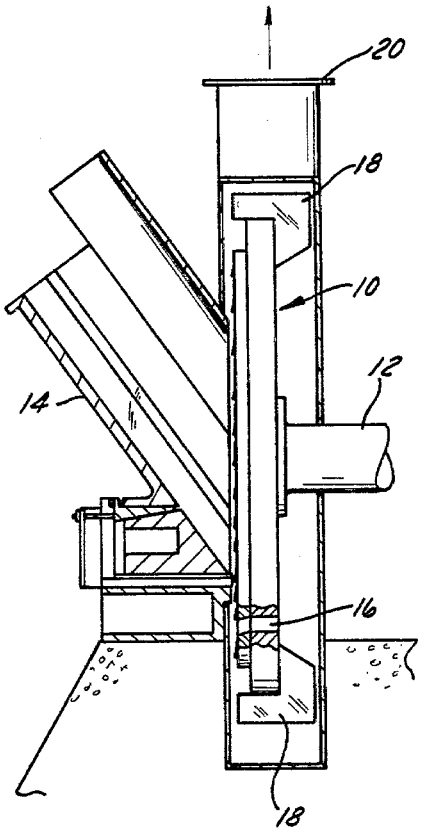
FIG. 2 is a vertical, sectional view of the chopping apparatus embodying the present invention.

The knife assembly described herein is typically for use in a chopping disc, as shown in FIG. 1. The disc 10 is rotatable about a shaft 12 powered by power means (not shown). The material to be chopped, such as logs, may be fed to the disc 10 through a spout 14 angularly disposed to the axis of the disc, as defined by the shaft 12. After the wood is chopped into small pieces or chips, those chips pass through radially disposed openings 16, the details of which will be explained later, and are then swept by a plurality of paddles 18 attached to the radial ends of disc 10 through a spout or discharge opening 20 for transfer to a remote location.

The knife assembly 22 includes an elongated knife seat 24 which constitutes a first knife holding means. The assembly 22 also includes an elongated knife cover 26 which constitutes a second knife holding means, a disc knife 28 which constitutes a reversible knife, and means 30 for clampingly engaging the knife 28 between the first and second knife holding means 24 and 26. The first knife holding means 24 is attached to the disc 10 and rotates therewith, and is also adjacent the radial opening 16 by which the chopped material passes through and away from the disc 10 after being chopped by the knife assembly. The second knife holding means 26 is mounted on the first knife holding means 24, as may be seen in FIG. 5, where an elongated slot 32 at the upper end of the second knife holding means 26 rests against an elongated support 30 of first knife holding means 24.

Figure 5:
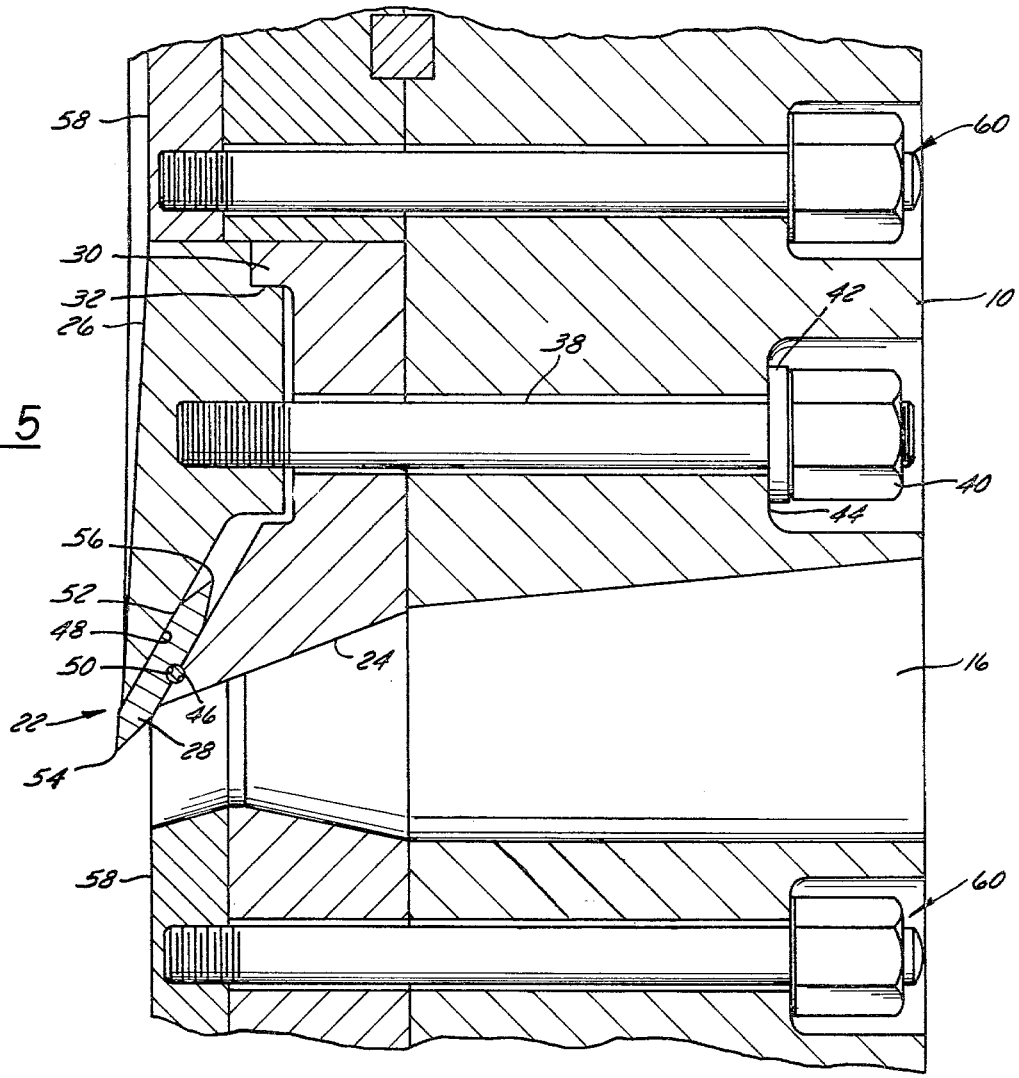
FIG. 5 is a cross-sectional view of the apparatus shown in FIG. 4, on a reduced scale, and also showing other parts of the rotatable chopping disc.

Means 30 for clampingly engaging the knife 28 between the first and second knife holding means includes a threaded stud 38, having one end threadably engaged in the second knife holding means 26, which permits easy replacement of second knife holding means 26 when it is worn or damaged. The other end of stud 38 is threaded, and is threadably engaged to a nut 40, which abuts the disc 10 through a special washer 42. As shown in FIG. 5, the slot 32 of second knife holding means 26 is tightly abutting the adjacent support 30 of first knife holding means 24, such that no rightward movement of second knife holding means 26, with respect to first knife holding means 24 is possible, and the knife 28 is firmly engaged therebetween. Stud 38, which passes through the knife holding means 24 and 26 and also through disc 10, permits relative movement of knife holding means 24 and 26. Assuming right-hand threads, counterclockwise rotation of nut 40 about the threaded end to which it is engaged results in space between nut 40 and washer 42 or between washer 42 and the disc face 44 abutting that washer. This space permits leftward movement of stud 38, which in turn permits leftward movement of second knife holding means 26 relative to first knife holding means 24. Knife 28 will then no longer be tightly engaged between means 24 and 26, and thus may be readily removed to facilitate reversal or replacement thereof, or to facilitate removal of the cylindrical or rod-like thrust element to be described hereinbelow.

One of the knife holding means will have a first knife-engaging portion including an arcuate protrusion thereon, and the other of the knife holding means will have a second knife-engaging portion including a flat knife-engaging surface. In the two embodiments described herein, the first knife holding means 24 will have the arcuate protrusion and the second knife holding means 26 will have the flat knife engaging surface.

Figure 3:
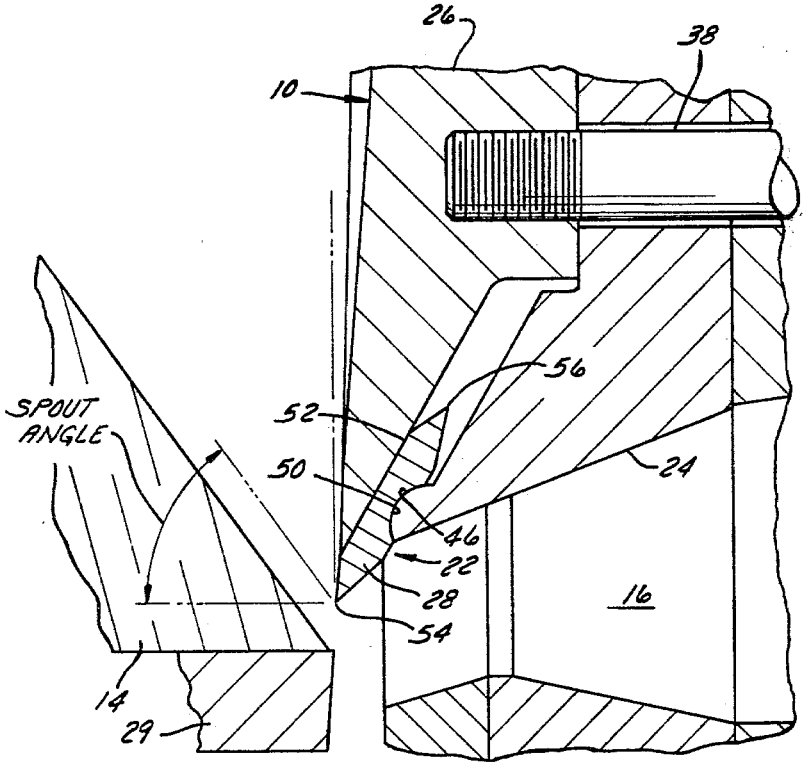
FIG. 3 is a cross-sectional view of a knife engaged between the two knife holding means taken along lines 3—3 of FIG. 1 but on an enlarged scale.
Figure 4:
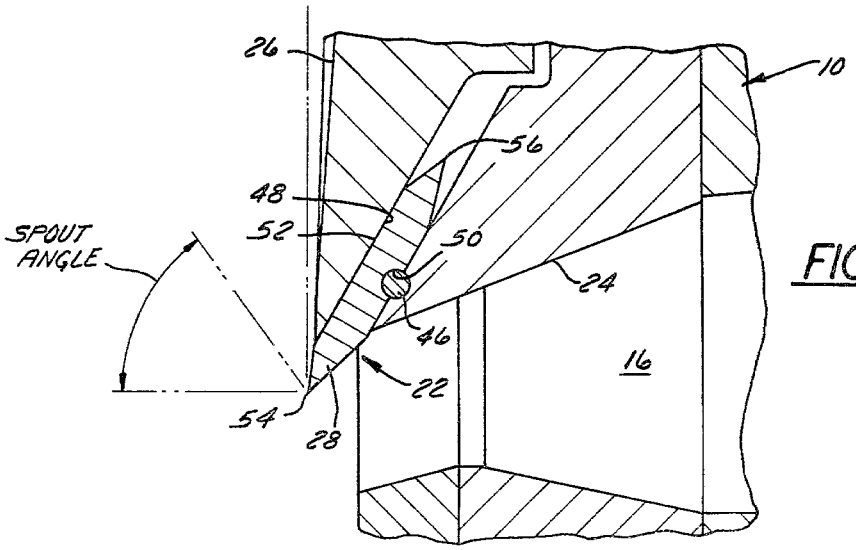
FIG. 4 is a cross-sectinal view of a knife engaged between the two knife holding means, comprising an alternate embodiment of the knife assembly shown in FIG. 3.

Each elongated knife seat insert 24 has attached across its length a knife 28, which may be of one-piece or multiple-piece construction; a three-piece knife, each piece being identical, is shown mounted beneath the elongated knife cover 26 of FIG. 1. Knife 28 chops material as it rotates on disc 10 by cooperative cutting action with face knife 29. Each knife 28 has two sides, each formed so as to either accept the arcuate protrusion 46 or to engage the flat knife-engaging surface 48. These two sides of the knife comprise the arcuate groove 50 and the complementary flat surface 52, respectively. In one of the two embodiments described herein, that shown in FIG. 3, the arcuate protrusion 46 is integrally formed on the first knife holding means and is semi-circular in cross section. This embodiment illustrated the ability of the knife 28, when mounted at its arcuate groove 50 about the protrusion 46, to align itself on the second knife holding means 26 and provide good contact thereagainst. In the second of the two embodiments described herein, that shown in FIGS. 4 and 5, the arcuate protrusion 46 comprises a cylindrical or rod-like element which is round in cross-section. The rod cooperatively engages a complementary shaped recess in the first knife holding means and with the knife's arcuate groove 50. This embodiment illustrates the ability of the protrusion 46, in the form of a rod, to act as a thrust element. The rod takes the thrust and wear that the first knife holding means 24 (FIG. 3) would take in the absence of the rod. Replacement of the rod is inexpensive and facilitated by merely loosening the nut 40 on stud 38 as described above to permit relative movement between first and second knife holding means 24 and 26 and removal of the knife 28 and rod 46 therebetween.

In both the embodiments, the second side of the knife comprises the complementary flat surface 52, which engages the flat knife-engaging surface 48 of second knife holding means 26. This flat surface 52, as explained hereinabove, transmits less stress per unit area to the flat knife-engaging surface 48 than any other configuration and thus permits the second knife holding means 26 to be constructed of a less expensive material than would be possible with another configuration.

The knife has two cutting edges 54 and 56. When edge 54 wears out, the knife holding means 24 and 26 are separated as described above, and the knife is rotated 180° about an axis normal to the axis defined by the protrusion of rod 46.

The apparatus is also provided with a plurality of replaceable disc wear plates 58, secured to the disc 10 with stud and nut means 60.

RECAPITULATION

The invention provides a knife-holding assembly which ensures good contact between the knife and knife holding means, eliminating the need for the very precise machining usually required for adequate heat transfer between the contact surfaces of the knife and the knife holder. One side of the knife has a flat contact surface, which transfer less stress to its respective knife holder and thus enables that knife holder to be constructed of a less-costly material. The invention further provides a knife-holding assembly with an inexpensive and easily replaced thrust element.

I claim:

1. In an apparatus for chopping material, comprising a rotatable disc and at least one radially disposed opening extending through said disc, a knife assembly comprising: a first knife holding means attached to said disc and adjacent said opening; a second knife holding means mounted on said first knife holding means; one of said knife holding means having a first knife engaging portion including an arcuate protrusion thereon; the other of said knife holding means having a second knife-engaging portion including a flat knife engaging surface; a reversible knife having two cutting edges and mounted between said first and second knife holding means, said knife having a complementary flat surface for cooperatively engaging said flat knife engaging surface of one of said holding means, said knife further having an arcuate groove for cooperatively engaging said arcuate protrusion; said arcuate protrusion comprising a rod which is round in cross section and which cooperatively engages with a complementary shaped recess in said first knife holding means and with said arcuate groove in said knife, and means for clampingly engaging said knife between said first knife holding means and said second knife holding means.

2. The apparatus set forth in claim 1, wherein said clamping engagement means comprises a stud with two ends, one of said ends fixed to said second knife holding means and the other of said ends being threaded, said threaded end being threadably engaged to a nut abutting said rotatable disc, whereby rotatin of said nut causes axial movement of said stud therealong and permits relative movement between said first knife holding means and said second knife holding means.

3. An elongated, reversible knife for attachment to a chopping disc, said knife having two opposite cutting edges each defined by two intersecting bevel surfaces, said knife having a pair of opposite flat surfaces extending completely between said bevel surfaces, and an arcuate recess formed in and along only one of said flat surfaces and being centered along the length of one of said flat surfaces for the reception of a complementary shaped rod of a knife holding means on said chopping disc.

* * * * *